US012263369B1

(12) United States Patent
Berg

(10) Patent No.: US 12,263,369 B1
(45) Date of Patent: Apr. 1, 2025

(54) EXERCISE APPARATUS FOR UPPER BODY AND METHOD OF USE

(71) Applicant: Robert Berg, Arlington, TX (US)

(72) Inventor: Robert Berg, Arlington, TX (US)

( * ) Notice: Subject to any disclaimer, the term of this patent is extended or adjusted under 35 U.S.C. 154(b) by 238 days.

(21) Appl. No.: 18/105,607

(22) Filed: Feb. 3, 2023

Related U.S. Application Data

(63) Continuation-in-part of application No. 17/528,556, filed on Nov. 17, 2021, now Pat. No. 11,813,492.

(51) Int. Cl.
*A63B 21/055* (2006.01)
*A63B 23/035* (2006.01)

(52) U.S. Cl.
CPC ..... *A63B 21/0552* (2013.01); *A63B 23/0355* (2013.01)

(58) Field of Classification Search
CPC ..... A63B 21/0004; A63B 21/4035; A63B 21/4045; A63B 21/4049; A63B 23/03541; A63B 23/12; A63B 23/1236
See application file for complete search history.

(56) References Cited

U.S. PATENT DOCUMENTS 4,461,473 A * 7/1984 Cole ..... A63B 21/0724 482/106
4,822,035 A * 4/1989 Jennings ..... A63B 21/0724 482/106
7,862,486 B1 * 1/2011 Watson ..... A63B 21/4017 482/106
7,909,746 B2 * 3/2011 Gant ..... A63B 21/4019 482/141
9,067,104 B1 * 6/2015 Kim ..... A63B 22/20
10,029,140 B2 * 7/2018 Douglass ..... A63B 21/4049
10,220,243 B2 * 3/2019 Koegel ..... A63B 21/075
11,000,725 B2 * 5/2021 Light ..... A63B 21/4049
12,023,545 B2 * 7/2024 Kinney ..... A63B 21/0724
2006/0030463 A1 * 2/2006 Maloy ..... A63B 23/1209 482/126
2010/0279833 A1 * 11/2010 Gant ..... A63B 21/00047 482/141
2013/0035218 A1 * 2/2013 Wierszewski ..... A63B 21/072 482/106
2017/0120104 A1 * 5/2017 Douglass ..... A63B 21/4049
2018/0117390 A1 * 5/2018 Koegel ..... A63B 23/04
2019/0275365 A1 * 9/2019 Bongelli ..... A63B 21/4035
2022/0249903 A1 * 8/2022 Cotton ..... A63B 21/4049

* cited by examiner

*Primary Examiner* — Joshua Lee
(74) *Attorney, Agent, or Firm* — Richard Eldredge; Leavitt Eldredge Law Firm

(57) ABSTRACT

An exercise apparatus for engaging upper body muscles of a person is disclosed. The exercise apparatus includes a generally circular frame having a first set of tracks mounted thereon; a bar extending horizontally across a diameter of the frame, the bar having opposing ends and a second set of tracks mounted thereon; a pair of movable members, wherein each movable member couples to an opposing end of the bar, wherein each movable member includes a handle coupled thereto; and one or more locking mechanisms coupled to the frame.

3 Claims, 6 Drawing Sheets

EXERCISE APPARATUS FOR UPPER BODY AND METHOD OF USE

CROSS REFERENCE TO RELATED APPLICATIONS

This application is a continuation of U.S. application Ser. No. 17/528,556, filed Nov. 17, 2021, of which is hereby incorporated by reference in its entirety.

BACKGROUND

1. Field of the Invention

The present invention relates generally to exercise machines, and more specifically to an exercise apparatus that incorporates movable handles on a circular frame in a manner which enables a user to focus on exercising their stabilizer muscles of the upper body.

2. Description of Related Art

Exercise machines are well known in the art and are effective means for enables users to promote physical and cardiovascular health during exercise. Common exercise machines include treadmills, ellipticals, benches, pullup bars, and the like. These exercise machines are often used to target certain desired muscle groups.

Although effective in most applications, conventional exercise machines have limitations. For example, conventional exercise machines are not constructed to facilitate multi-directional movement during various upper body exercises.

Accordingly, it is an object of the present invention to provide an exercise apparatus that enables a user to target specific muscle groups in the upper body, including stabilizer muscles, during upper body exercises.

DESCRIPTION OF THE DRAWINGS

The novel features believed characteristic of the embodiments of the present application are set forth in the appended claims. However, the embodiments themselves, as well as a preferred mode of use, and further objectives and advantages thereof, will best be understood by reference to the following detailed description when read in conjunction with the accompanying drawings, wherein:

Figure 1:
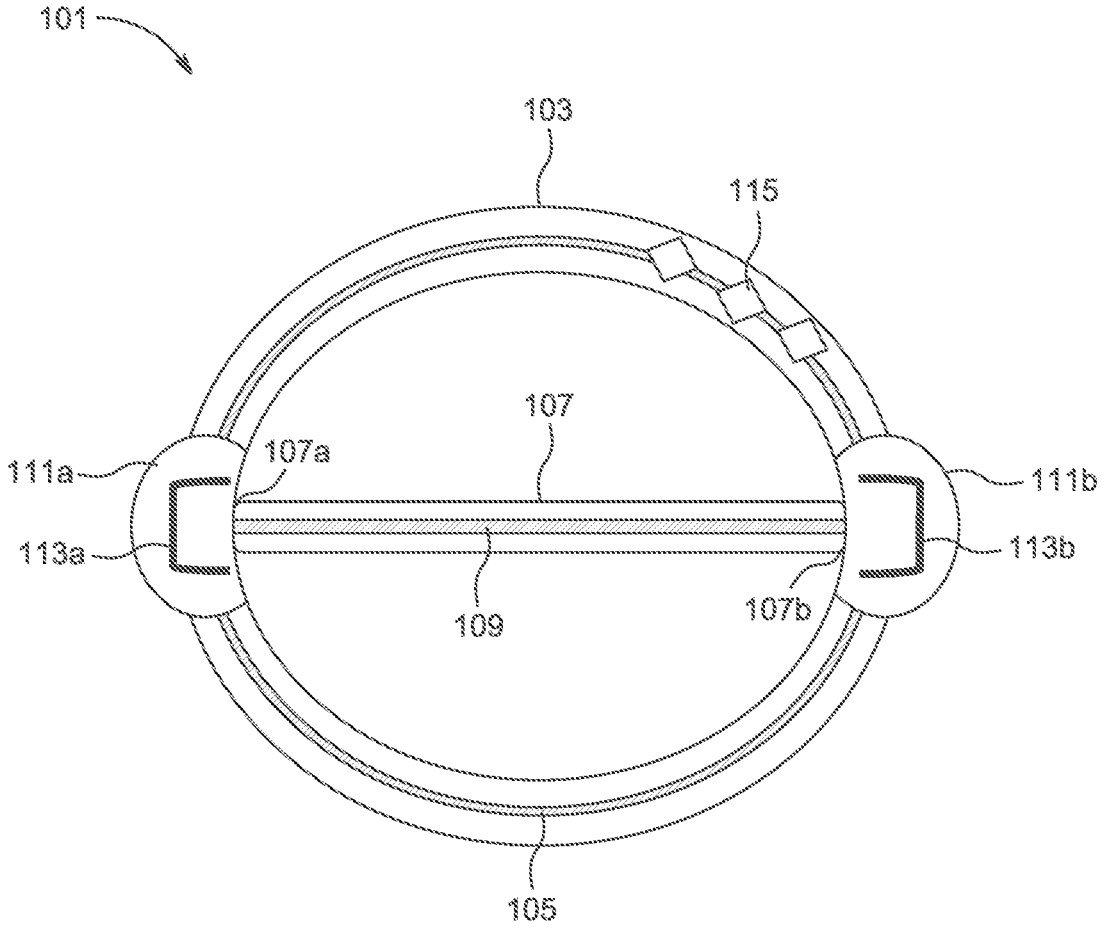
FIG. 1 is a top view of an exercise apparatus in accordance with a preferred embodiment of the present invention.

While the system and method of use of the present application is susceptible to various modifications and alternative forms, specific embodiments thereof have been shown by way of example in the drawings and are herein described in detail. It should be understood, however, that the description herein of specific embodiments is not intended to limit the invention to the particular embodiment disclosed, but on the contrary, the intention is to cover all modifications, equivalents, and alternatives falling within the spirit and scope of the present application as defined by the appended claims.

DETAILED DESCRIPTION OF THE PREFERRED EMBODIMENT

Illustrative embodiments of the system and method of use of the present application are provided below. It will of course be appreciated that in the development of any actual embodiment, numerous implementation-specific decisions will be made to achieve the developer's specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

The system and method of use in accordance with the present application overcomes one or more of the above-discussed problems commonly associated with conventional exercise machines. Specifically, the present invention provides for an exercise apparatus that utilizes movable handle grips to facilitate 360-degree movement, thereby allowing a user to target certain muscle groups, including stabilizer muscles, for a multitude of upper body exercises. These and other unique features of the system and method of use are discussed below and illustrated in the accompanying drawings.

The system and method of use will be understood, both as to its structure and operation, from the accompanying drawings, taken in conjunction with the accompanying description. Several embodiments of the system are presented herein. It should be understood that various components, parts, and features of the different embodiments may be combined together and/or interchanged with one another, all of which are within the scope of the present application, even though not all variations and particular embodiments are shown in the drawings. It should also be understood that the mixing and matching of features, elements, and/or functions between various embodiments is expressly contemplated herein so that one of ordinary skill in the art would appreciate from this disclosure that the features, elements, and/or functions of one embodiment may be incorporated into another embodiment as appropriate, unless described otherwise.

The preferred embodiment herein described is not intended to be exhaustive or to limit the invention to the precise form disclosed. It is chosen and described to explain the principles of the invention and its application and practical use to enable others skilled in the art to follow its teachings.

Referring now to the drawings wherein like reference characters identify corresponding or similar elements throughout the several views, FIG. 1 depicts a schematic representation of an exercise apparatus 101 in accordance with a preferred embodiment of the present application. It will be appreciated that the exercise apparatus 101 overcomes one or more of the above-listed problems commonly associated with conventional exercise machines. In addition, it should be appreciated that the exercise apparatus 101 may vary based on aesthetical, functional, or manufacturing considerations.

In the contemplated embodiment, the exercise apparatus 101 includes a generally circular frame 103 having a first set of tracks 105 mounted thereon. The exercise apparatus 101 also includes a bar 107 having opposing ends 107*a*, 107*b* and a second set of tracks 109 mounted thereon. The bar 105 extends horizontally across the diameter of the frame 103. In addition, each opposing end 105, 105*b* couples to a movable member 111*a*, 111*b*, respectively. Each movable member 111*a*, 111*b* includes a handle 113*a*, 113*b*, coupled thereto, respectively. The movable members 111*a*, 111*b* are configured to slide along tracks 107, 109 and configured to rotate in a 360-degree direction. The handles 113*a*, 113*b* provide grip for a user to grasp during use.

It should be appreciated that the bar 107 rotates as the movable members 111*a*, 111*b* rotate, thereby allowing a user to perform a chest squeeze movement during an exercise.

It should also be appreciated that the handles 113*a*, 113*b* may include a tension mechanism (not shown) to provide added resistance for hand and forearm exercises.

The exercise apparatus 101 further includes one or more locking mechanisms 115 along the frame 103. The one or more locking mechanisms 115 are configured to lock the movable members 111*a*, 111*b* in place on the frame 103, on the bar 107, or both. It should be appreciated that the one or more locking mechanisms 115 may include markings indicating various angles so that the user can visualize specific placement of the movable members 111*a*, 111*b*, thereby enabling the user to optimize muscle development.

It should also be appreciated that one of the unique features believed characteristic of the present application is that it enables the user to slide and rotate the movable members 111*a*, 111*b* to any desired position to engage both a specific area in the upper body and upper stabilizer muscles.

Figure 2:
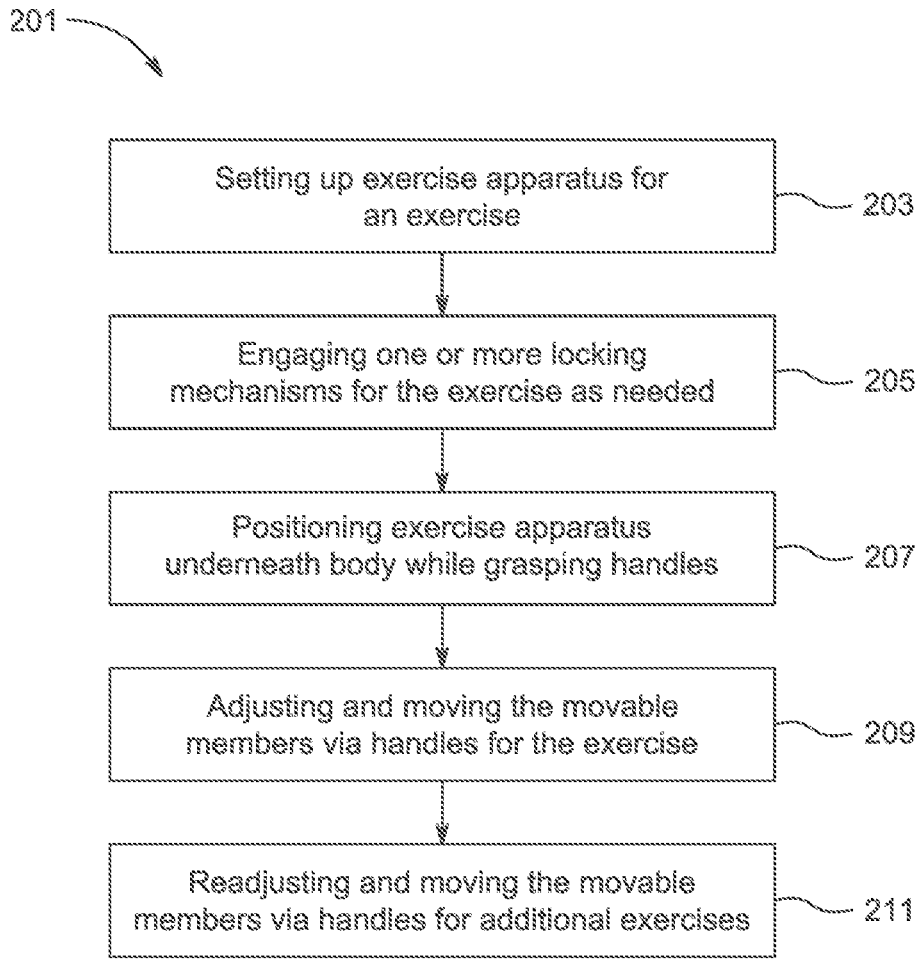
FIG. 2 is a flowchart of a method of use of the exercise apparatus of FIG. 1.
Figure 3:
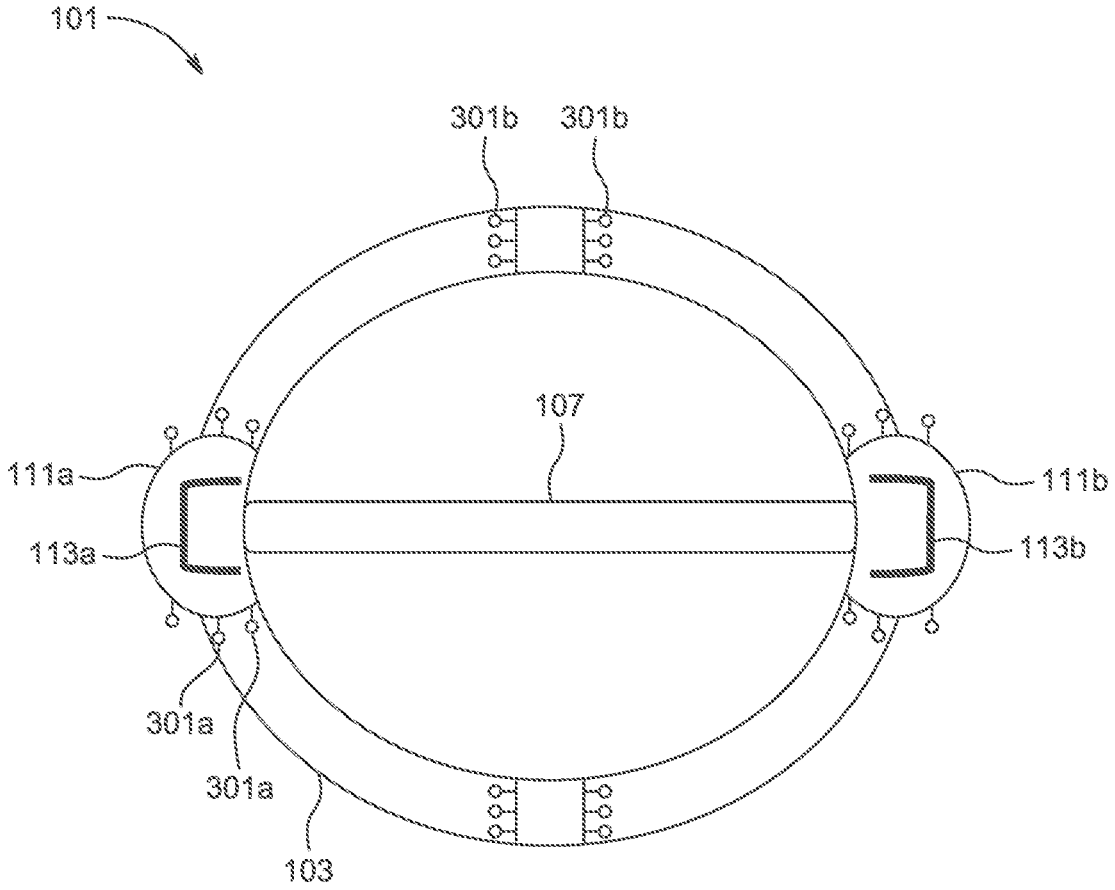
FIG. 3 is a top view of the exercise of the exercise apparatus of FIG. 1, illustrating ports for resistant band attachment.
Figure 4:
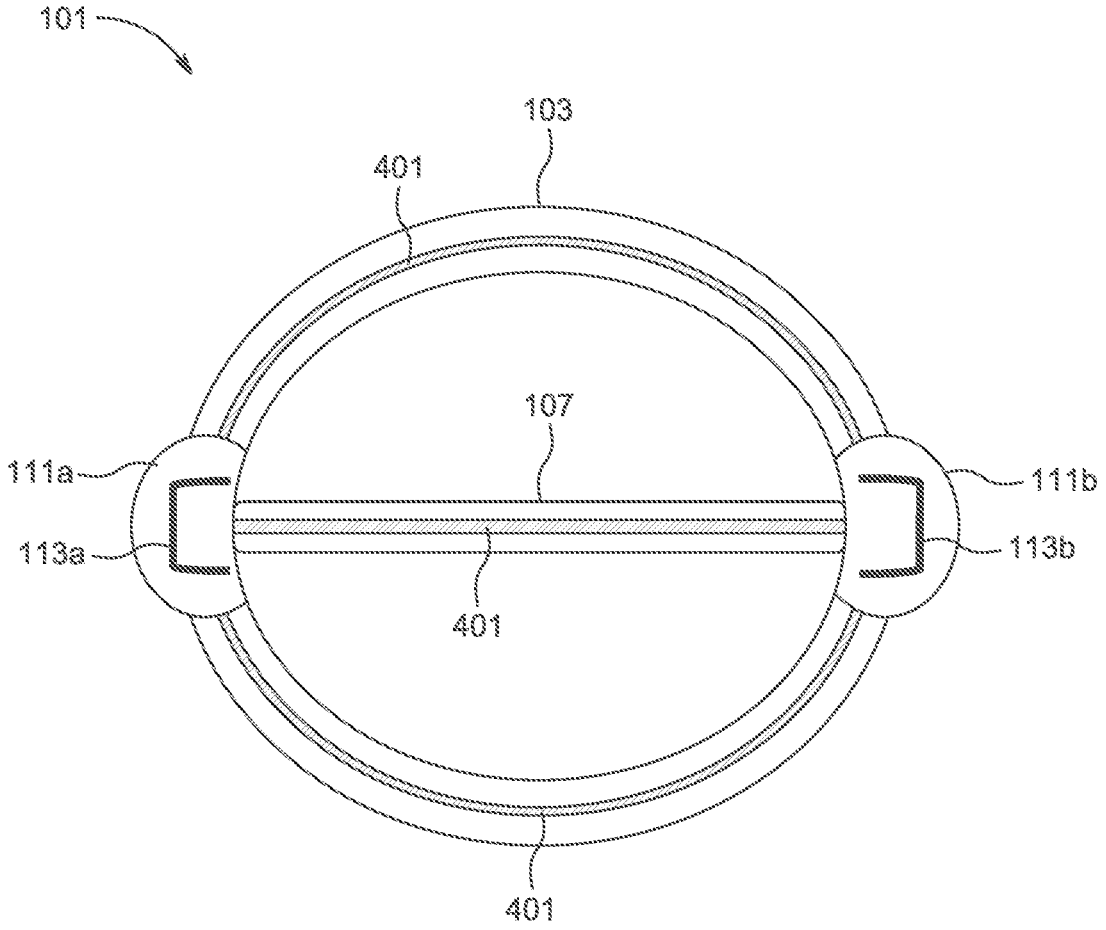
FIG. 4 is a top view of the exercise of the exercise apparatus of FIG. 1, illustrating removable springs for additional resistance.
Figure 5:
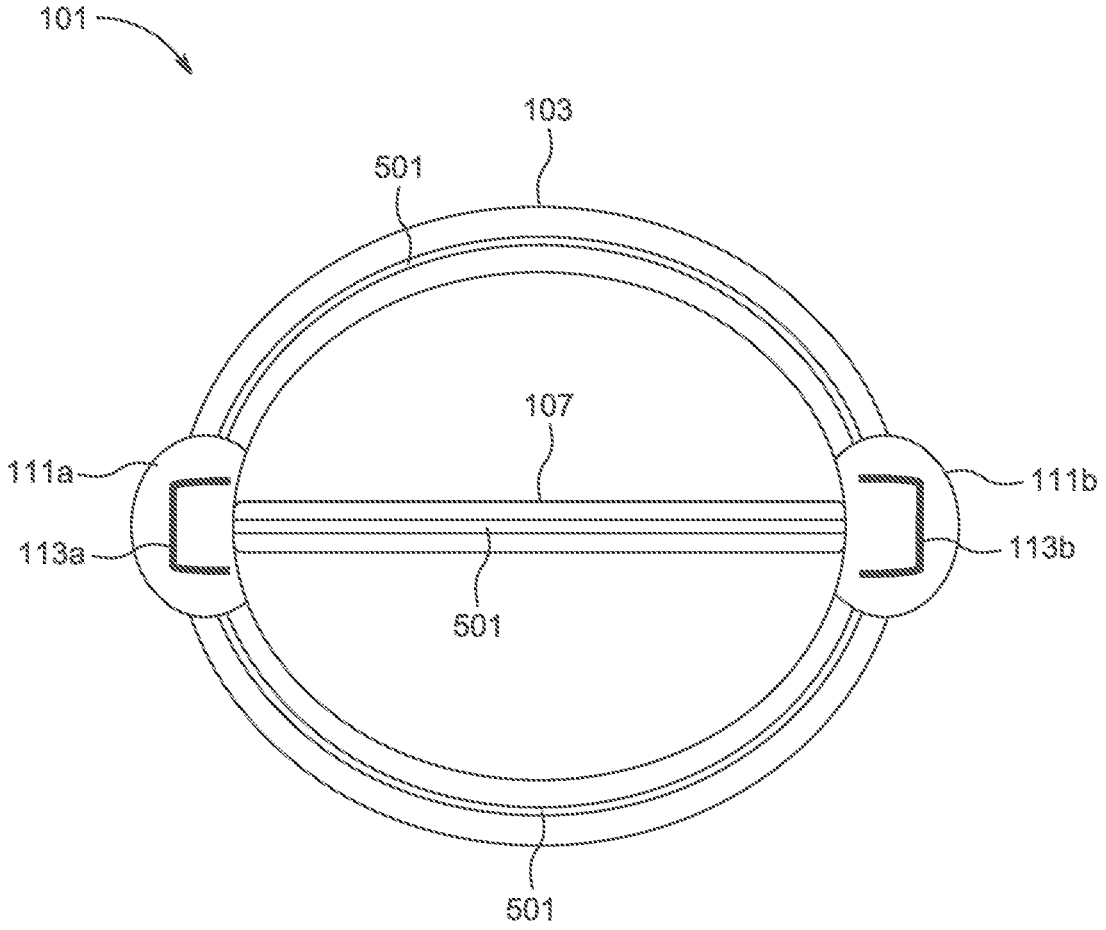
FIG. 5 is a top view of the exercise of the exercise apparatus of FIG. 1, illustrating an internal cable system.
Figure 6:
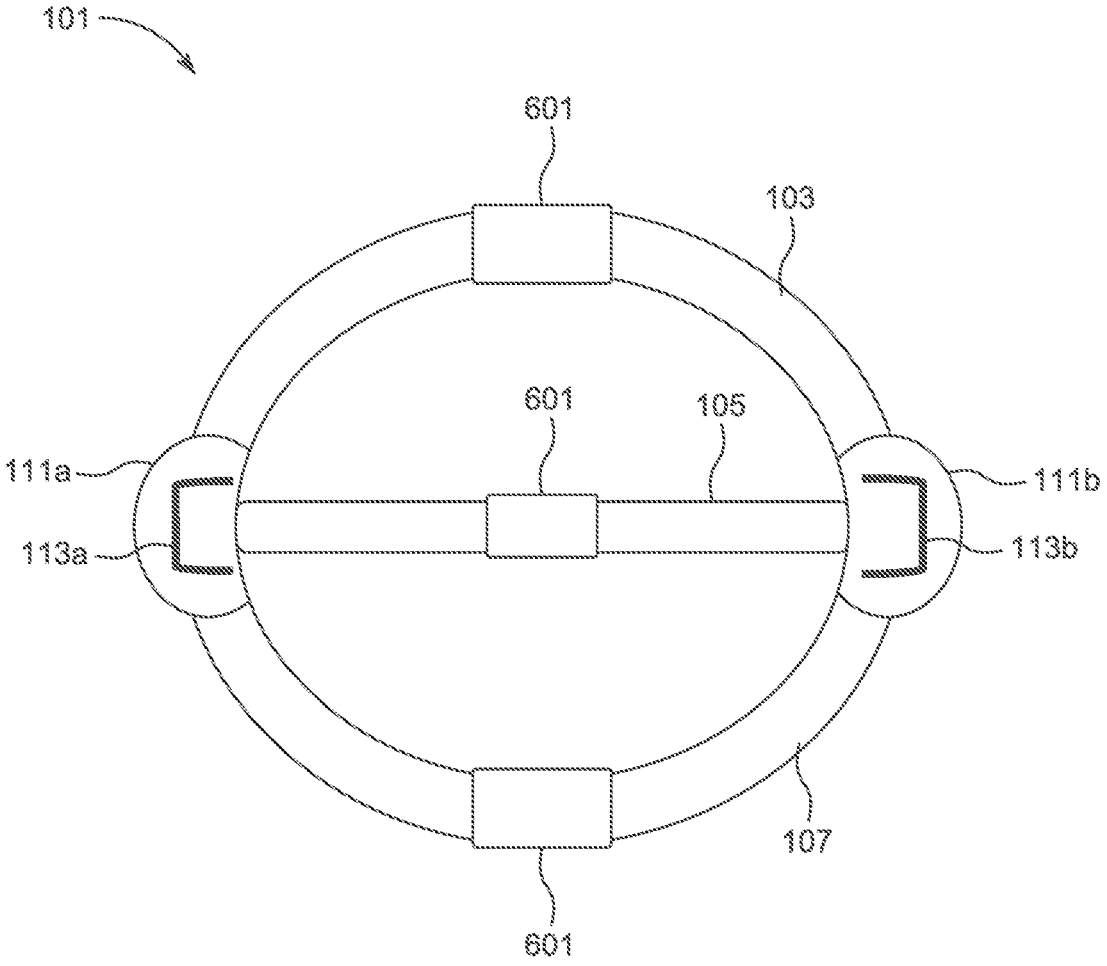
FIG. 6 is a top view of the exercise of the exercise apparatus of FIG. 1, illustrating an adjustment mechanism.

In FIG. 2, a flowchart 201 depicts a simplified method of use associated with system 101. During use, when the exercise apparatus is setup for an exercise, the user can engage the one or more locking mechanisms for the exercise as needed, as shown with boxes 203, 205. The user can then position their body over the exercise apparatus while grasping the handles, as shown with boxes 207. The user can adjust and move the handles for the exercise, as shown with box 209. In one example, the user may move the handles towards the center of the bar during a downward movement of a pushup, and then move the handles in an out-and-up circular motion during an upward movement of the pushup. The user can readjust and move the handle for additional exercises, as shown with box 211.

In FIGS. 3 through 6, top views of the exercise apparatus 101 are depicted. As shown, the exercise apparatus 101 also includes a plurality of ports (e.g., port 301*a*, port 301*b*) generally referred to as ports 301, a plurality of removable springs 401, an internal cable system 501, and an adjustment mechanism 601. It should be appreciated that some components of the exercise apparatus 101 have been removed for illustrative purposes only.

The ports 301 are fixed to the frame 103 and to handles 113*a*, 113*b*. The ports 301 are configured to allow removable attachment of one or more exercise resistance bands (not shown) thereto. It should be appreciated that the ports 301 enable the user to perform a variety of exercises with added resistance.

The removable springs 401 engage with the frame 103 and the bar 107. It should be appreciated that the removable springs 401 provide added resistance during use.

The internal cable system 501 engages with the frame 103, the bar 107, and the movable members 111*a*, 111*b*. The internal cable system 501 allows the movable members 111*a*, 111*b* with their respective handles 113*a*, 113*b* to disengage from the frame 103 but remain connected with the internal cable system 501. It should be appreciated that the internal cable system 501 provides resistance when the user performs a variety of exercises with the disengaged movable members 111*a*, 111*b* such as curls, squats, delt raises, delt fly's, shoulder shrugs, deadlifts, Romanian deadlifts, and the like.

The adjustment mechanism 601 engages with the frame 103 and the bar 107. The adjustment mechanism 601 is configured to allow the user to adjust the size of the exercise apparatus 101 according to the user's preference.

In some embodiments, it should be appreciated that the exercise apparatus 101 may include slip-resistance material (not shown) to provide grip.

The particular embodiments disclosed above are illustrative only, as the embodiments may be modified and practiced in different but equivalent manners apparent to those skilled in the art having the benefit of the teachings herein. It is therefore evident that the particular embodiments disclosed above may be altered or modified, and all such variations are considered within the scope and spirit of the application. Accordingly, the protection sought herein is as set forth in the description. Although the present embodiments are shown above, they are not limited to just these embodiments, but are amenable to various changes and modifications without departing from the spirit thereof.

What is claimed is:

1. An exercise apparatus, comprising:

a generally circular frame having a first set of tracks mounted thereon;

a bar extending horizontally across a diameter of the frame, the bar having:

opposing ends; and a second set of tracks mounted thereon;

a pair of movable members, wherein each movable member couples to an opposing end of the bar, wherein each movable member includes a handle coupled thereto, the movable members configured to slide along the first and second set of tracks and configured to rotate in a 360-degree direction;

one or more locking mechanisms coupled to the frame, the one or more locking mechanisms configured to lock the movable members in place on the frame, the bar, or both;

a plurality of ports fixed to the frame and the handle on each movable member, the plurality of ports configured to allow removable attachment of one or more exercise resistance bands thereto;

a plurality of removable springs engaged with the frame and the bar, the plurality of removable springs configured to provide added resistance;

an internal cable system engaged with the frame, the bar, and the movable members, the internal cable system configured to allow the movable members to disengage from the frame but remain connected thereto; and an adjustment mechanism engaged with the frame and the bar, the adjustment mechanism configured to allow the user to adjust the size of the exercise apparatus.

2. The exercise apparatus of claim 1, wherein the handles include a tension mechanism to provide added resistance for hand and forearm exercises.

3. The exercise apparatus of claim 1, further comprising slip-resistance material to provide grip.

* * * * *